US006193098B1

(12) United States Patent
Mochizuki et al.

(10) Patent No.: US 6,193,098 B1
(45) Date of Patent: Feb. 27, 2001

(54) INSULATING CONTAINER

(75) Inventors: Yoichi Mochizuki; Yuichi Hirai; Kazuki Yamada, all of Tokyo (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 0 days.

(21) Appl. No.: 09/463,122

(22) PCT Filed: May 20, 1999

(86) PCT No.: PCT/JP99/02628

§ 371 Date: Jan. 19, 2000

§ 102(e) Date: Jan. 19, 2000

(87) PCT Pub. No.: WO99/59883

PCT Pub. Date: Nov. 25, 1999

(30) Foreign Application Priority Data

May 20, 1998 (JP) ..... 10-153646
Jun. 2, 1998 (JP) ..... 10-152374

(51) Int. Cl.[7] ..... B65D 3/22
(52) U.S. Cl. ..... 220/592.17; 229/403
(58) Field of Search ..... 220/592.17, 592.18, 220/592.27, 592.28; 229/403, 4.5, 198.2, 738

(56) References Cited

U.S. PATENT DOCUMENTS 5,469,983 * 11/1995 Yawata ..... 229/403
5,524,817 * 6/1996 Meier et al. ..... 229/403
5,839,653 * 11/1998 Zadravetz ..... 229/403
5,964,400 * 10/1999 Varano et al. ..... 229/403
6,068,182 * 5/2000 Tokunaga ..... 229/403
6,085,970 * 7/2000 Sadlier ..... 229/403

FOREIGN PATENT DOCUMENTS 5-52003 9/1973 (JP) .
5-97282 1/1976 (JP) .
5-37985 3/1977 (JP) ..... B29C/24/00
6-1274 1/1994 (JP) ..... B65D/81/34
18250 3/1994 (JP) ..... B65D/25/28
44776 6/1994 (JP) ..... B65D/81/34
76018 10/1994 (JP) ..... B65D/3/00
0 207969 8/1996 (JP) ..... B65D/81/34
0 959883 11/1999 (JP) ..... B65D/81/34

* cited by examiner

*Primary Examiner*—Joseph M. Moy
(74) *Attorney, Agent, or Firm*—Ladas & Parry

(57) ABSTRACT

A heat-insulating container comprises a paper cup body having an inner surface, an upper open end, a shell member and a bottom, the inner surface being coated with polyolefine resin, the upper open end having an outward curled portion and the shell member having a side wall on which at least one rib is formed; and a tubular member being formed of paper and having an inverse truncated conical shape, the tubular member having at a lower end thereof an inward curled portion. The tubular member is combined with an outer periphery of the paper cup body so as to come into contact with the paper cup body in contact portions provided on the at least one rib of the paper cup body and on an outer periphery of an lower end of the side wall of the shell member. According to such a structure, it is possible to provide the heat-insulating container, which has a stable heat-insulating property, a high grade design, a high degree of freedom in indication by printing on the outer surface of the container, and a lower production cost.

7 Claims, 9 Drawing Sheets

INSULATING CONTAINER

TECHNICAL FIELD

The present invention relates to a heat-insulating container made of paper, which is used for an instant dried food to be become eatable by pouring boiling water over it or food to be heated or cooked by means of a microwave oven.

BACKGROUND ART

As a heat-insulating container made paper mainly used for instant dried Chinese noodles, there has widely been used a container in which a paper cup body surrounded over its outer periphery with a heat-insulating corrugated member having narrow projections and recesses arranged alternately.

The heat-insulating member of the heat-insulating container has the above-mentioned irregularity so that characters, designs or the like printed on its surface appear extremely unclearly, thus making it impossible to give the high-grade appearance of design to the container.

In Japanese Patent Provisional Publication No. H8-113274, there is proposed a heat-insulating container in which the width of the recesses of the heat-insulating member is made smaller than that of the projections so that the total area of clearly visible portions on the outer periphery of the container is increased. However, the recesses appearing on the outer periphery of the container do not provide complete solution of the above-mentioned problems.

In Japanese Patent Provisional Publication No. S49-87479, Japanese Patent Provisional Publication No. H4-45216 and Japanese Patent Provisional Publication No. H8-104373, there is proposed a heat-insulating container, in which a heat-insulating member subjected to a corrugating process or an embossing process is surrounded with a liner or a shin sheet of paper so that no irregularity is formed on the outer surface of the container. Such a container can solve the problems of the appearance on its outer periphery. However, the bottom of the heat-insulating container may have irregularity in the joined portions of the heat-insulating member and the liner. When observation from the bottom side of the container is made, the edge of the corrugated or embossed heat-insulating member appears through a gap formed in the bottom of the container. Dirt or liquid may enter the gap of the bottom of the container, thus causing insanitary problems. The additional liner provides an increased production cost.

In Japanese Utility Model Provisional Publication No. 4-45212, there is proposed a heat-insulating container in which a heat-insulating property is ensured without using any heat-insulating member having irregularity. The heat-insulating container has for example a construction as shown in FIG. 11. More specifically, the heat-insulating container 100 is provided with a paper cup body 101 having a bottom plate 102 and a side shell-wall 103 and with a tubular member 105 arranged on the outer periphery of the side shell-wall 103. The paper cup body 101 and the tubular member 105 come on their opposite edges into contact with each other to be joined with each other into an integral body. The side shell-wall 103 is provided on its upper edge with an inward curled portion 104. The tubular member 105 is provided on its lower edge with an inward curled portion 106. A heat-insulating space corresponding to the thickness of the curled portion 106 is formed between the side shell-wall 103 and the tubular member 105.

Such a heat-insulating container 100 does not use any specific heat-insulating member having irregularity and has therefore no disadvantage caused by the heat-insulating member. When the container is actually held at the central portion of the side shell-wall thereof with a hand, the tubular member may however easily be deformed inward to decrease the capacity of the heat-insulating space, thus deteriorating the heat-insulating property.

DISCLOSURE OF INVENTION

An object of the present invention, which was made in order to solve the above-mentioned problems, is to provide a heat-insulating container, which has a stable heat-insulating property, a high grade design, a high degree of freedom in indication by printing on the outer surface of the container, and a lower production cost.

In order to attain the above-described object, the heat-insulating container according to an embodiment of the present invention comprises:

a paper cup body having an inner surface, an upper open end, a shell member and a bottom, said inner surface being coated with polyolefine resin, said upper open end having an outward curled portion and said shell member having a side wall on which at least one rib is formed; and a tubular member being formed of paper and having an inverse truncated conical shape, said tubular member having at a lower end thereof an inward curled portion;

said tubular member being combined with an outer periphery of said paper cup body so as to come into contact with said paper cup body in contact portions provided on said at least one rib of said paper cup body and on an outer periphery of an lower end of said side wall of said shell member.

In the heat-insulating container of the present invention, the tubular member may be adhesively joined to the paper cup body in at least one of the contact portions. The rib may continuously extend over the entire periphery of the side wall of the shell member of the paper cup body, or intermittently extend along the periphery of the side wall of the shell member of the paper cup body. The inward curled portion formed on the lower end of the tubular member may be adhesively joined to the side wall of the shell member of the paper cup body. The rib may have a shape in a vertical cross section so that an inclination angle of an upper portion of the rib locating above a peak of the rib relative to a vertical line passing through the peak is smaller than an inclination angle of a lower portion of the rib locating below the peak relative to the vertical line. The tubular member has a rib, which projects inward so as to face the rib of the paper cup body.

The heat-insulating container according to the other embodiment of the present invention comprises:

a paper cup body having an inner surface, an upper open end and a bottom, said inner surface being coated with polyolefine resin and said upper open end having an outward curled portion; and a tubular member being formed of paper and having an inverse truncated conical shape, said tubular member having at a lower end thereof an inward curled portion;

said tubular member being combined with an outer periphery of said paper cup body so as to form a heat-insulating space between an outer surface of a side wall of a shell member of said paper cup body and an inner surface of said tubular member, said tubular member being provided with two handle-shaped pieces each of which is defined by at least one folding line and at least one cutting line that is formed by punching a side wall of a shell member of said tubular member, and said handle-shaped pieces being capable of extending outward from the side wall of the shell member of said tubular member to form handles on an outer periphery of said tubular member, by folding said handle-shaped pieces along said at least one folding line so as to face each other.

According to such a heat-insulating container, it can be held safely with hand even when the temperature of the outer wall becomes high due to the deteriorated heat-insulating property.

Each of the at least one cutting line may have at least one connection portion, which can easily be cut off. Each of the handle-shaped pieces may have on its peripheral portion a cutout. The side wall of the shell member of the paper cup body may have at least one rib extending outward or inward. When a sheet of paper of which the tubular member is formed has a basic weight of up to 270 g/m$^2$, the at least one rib preferably extends outward. The at least one cutting line may comprise a single cutting line that is provided in an outer peripheral portion of each of the handle-shaped pieces; and the at least one folding line may comprise a single folding line that extends so as to connect opposite ends of the single cutting line to each other.

BEST MODE FOR CARRYING OUT THE INVENTION

Figure 1A:
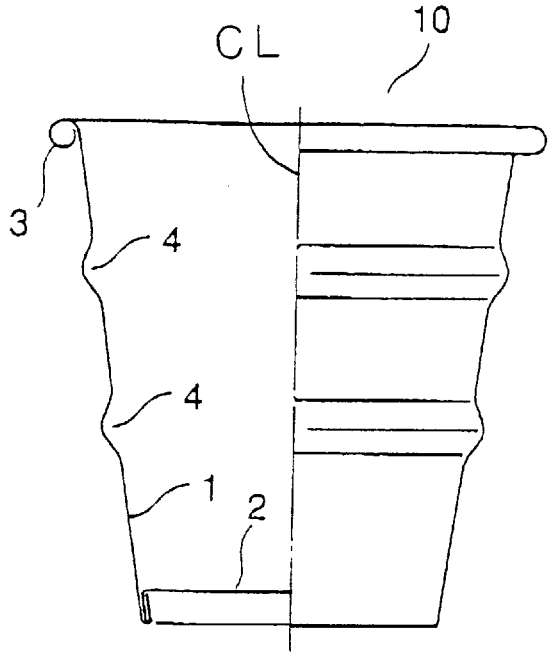
FIG. 1 is a descriptive view of a structure of a heat-insulating container of the first embodiment of the present invention.
Figure 1B:
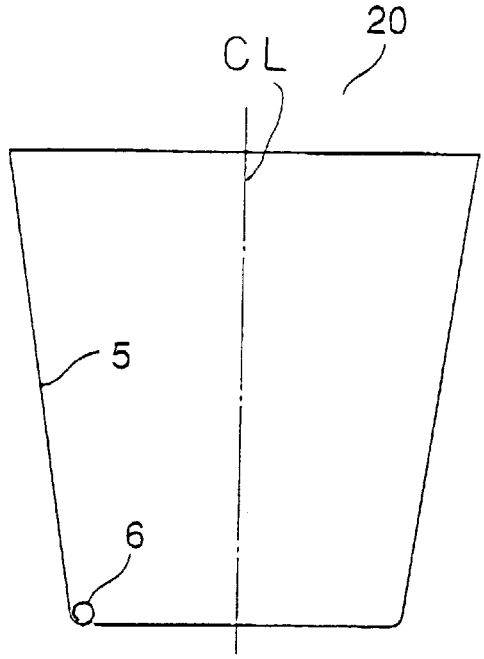
Figure 1C:
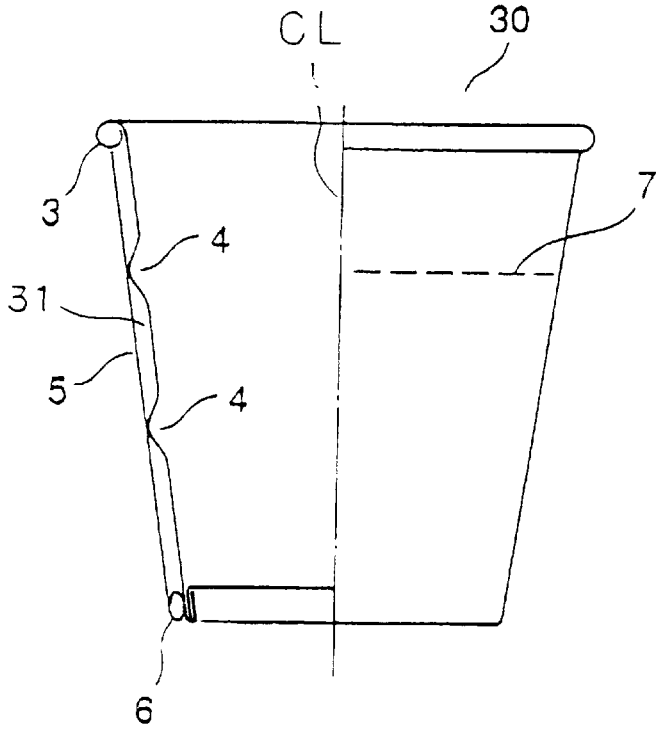

FIG. 1 is a descriptive view of a structure of the heat-insulating container of the first embodiment of the present invention.

The heat-insulating container 30 as shown in FIG. 1 has a paper cup body 10 and a tubular member 20. Both of the paper cup body 10 and the tubular member 20 are formed of a sheet of paper. The right-hand side relative to the central line CL in each of FIGS. 1(*a*) to 1(*c*) shows the external appearance of the container and the left-hand side relative thereto shows the cross section of the container.

The paper cup body 10 has a side shell-wall 1 and a bottom plate 2. As shown in FIG. 1(*a*), the side shell-wall 1 is provided on its upper edge with an outward curled portion 3. The side shell-wall 1 is provided on its middle portion with two horizontal ribs 4 projecting outward. The number of the horizontal ribs is not limited to two and the single rib or three or more ribs may be provided. As show in FIG. 1(*b*), the tubular member 20 is formed into an inverse truncated conical shape having the opposite openings. The tubular member 20 is provided on its lower edge with an inward curled portion 6. The paper cup body 10 and the tubular member 20 are combined with each other to form an integral body as shown in FIG. 1(*c*). In such a combination, the inner surface of the tubular member 20 comes into contact with the outer periphery of each of the at least one horizontal rib 4 and the inner periphery of the inward curled portion 6 of the tubular member 20 comes into contact with the outer periphery of the lower portion of the side shell-wall 1, which forms the bottom of the paper cup body 10. It is preferable to put the tubular member 20 into the paper cup body 10 so that the upper portion of the tubular member 20 comes into close contact with the inner side of the curled portion 3 of the paper cup body 10. The tubular member 20 and the side shell-wall 1 are adhesively joined to each other so that the tubular member 20 does not come off the paper cup body 10. An adhesion step applied to at least one of contact portions of the paper cup body 10 with the tubular member 20 (i.e., three contact portions on the outer peripheries of the two horizontal ribs 4, 4 and the inner periphery of the curled portion 6 in FIG. 1(*c*)) suffices.

The horizontal rib 4 provided on the side shell-wall 1 of the cup body 10 has functions of supplementing the strength of the cup body 10 as well as forming a heat-insulating space 31 between the tubular member 20 and the side shell-wall 1. The position of the horizontal rib 4 may be determined taking into consideration the balance in strength of the cup body 10. As shown in FIG. 1(*c*), at least one horizontal rib 4 may serve as a line indicating an appropriate level to which boiling water is to be poured into the cup body 1, i.e., a standard line 7 for boiling water.

Figure 11:
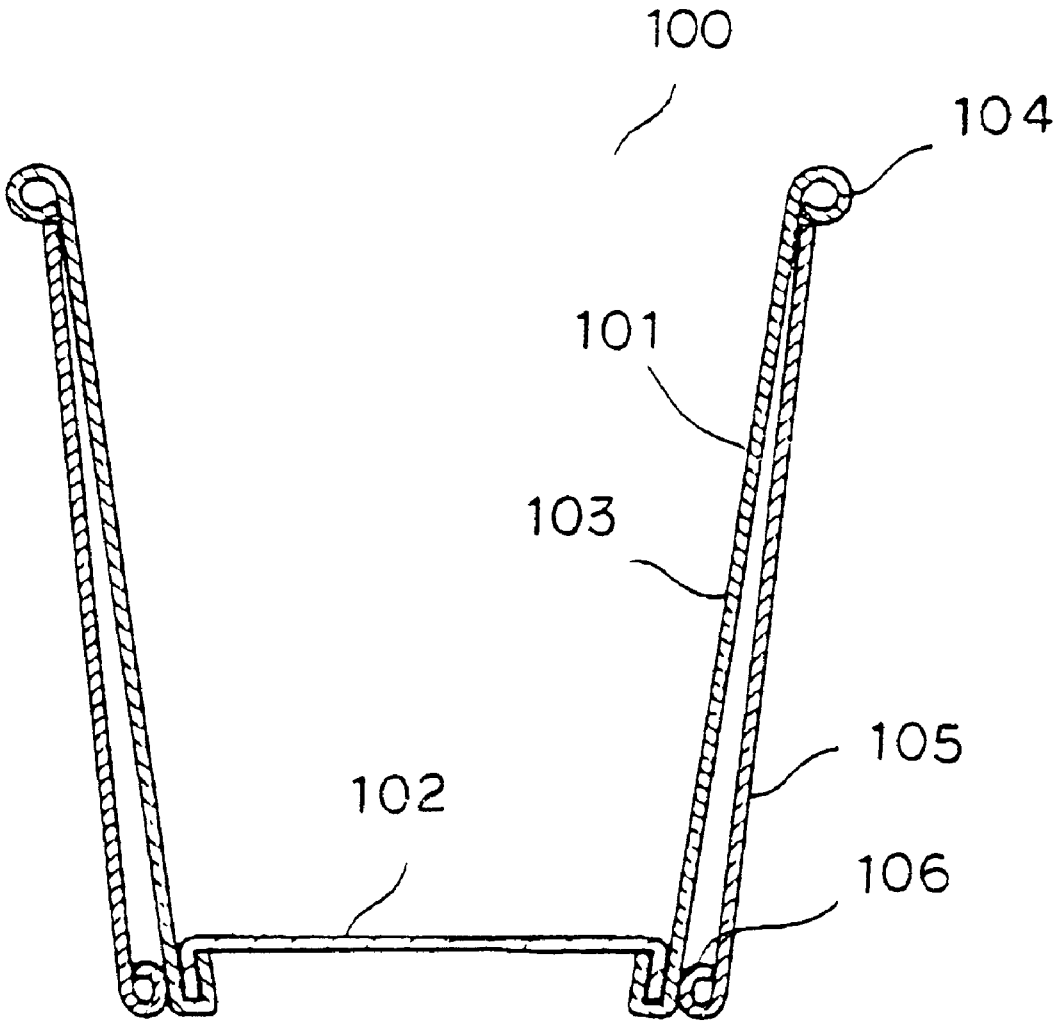
FIG. 11 is a cross-sectional view of the conventional heat-insulating container.

In the heat-insulating container 30 as shown in FIG. 1(*c*), the side wall 5 of the tubular member 20 is supported from the inside by means of the horizontal ribs 4, unlike the conventional heat-insulating container 100 as shown in FIG. 11. It is possible to reduce an amount of inward deformation of the side wall 5 when the side shell-wall 1 is held with hand. Accordingly, a sufficient width of the heat-insulating space 31 (i.e., the length of the container 30 in its radial direction) can be ensured, thus achieving an excellent heat-insulating property.

The width of the heat-insulating space 31 can be determined so as to be substantially uniform or increased gradually toward the lower end of the container 30 by controlling the height of the horizontal ribs 4 and the projection length of the inward curled portion 6 of the tubular member 20. Such a structure can provide the entirety of the side wall of the container 30 with an excellent heat-insulating property, which could not been provided in the conventional heat-insulating container 100.

According to the present invention, it is therefore possible to provide the heat-insulating container, which can sufficiently be used for receiving not only dried foods such as instant dried Western soup, instant dried miso soup or the like, over which boiling water is to be poured in a relatively small amount, but also dried foods such as instant dried Chinese noodles, over which boiling water has to be poured up to the upper edge of the heat-insulating container 30.

Figure 2A:
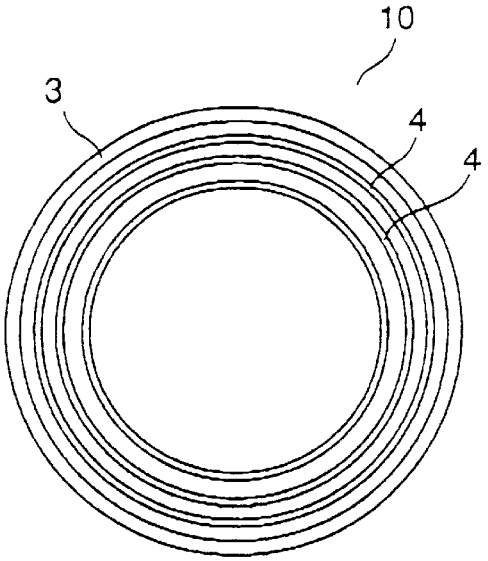
FIG. 2 is a bottom view illustrating the cup body of the heat-insulating container of the first embodiment of the present invention.
Figure 2B:
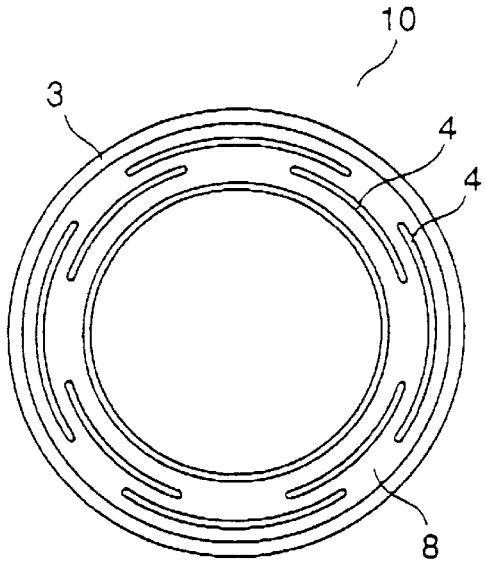

FIG. 2 is a bottom view illustrating the cup body 10 of the heat-insulating container of the first embodiment of the present invention. The horizontal ribs 4 of the cup body 10 may be formed so as to continuously extend over the entire periphery of the side shell-wall 1 as shown in FIG. 2(*a*). As shown in FIG. 2(*b*), the horizontal rib 4 may have discontinued portions 8 so that it is divided into a plurality of rib portions extending along the periphery of the side shell-wall 1.

The formation of the intermittent horizontal rib portions 4 can provide advantage of enlarging the heat-insulating space 31, although the same excellent effect as the horizontal rib 4 formed continuously of preventing the side wall from being deformed can not be provided. The heat-insulating space 31 passes through the interior ranging from the upper end of the tubular member 20 to the lower end thereof without being separated by the horizontal rib 4. Accordingly, it is possible to facilitate the movement of air received in the heat-insulating space 31 so as to perform a uniform increase in temperature, thus improving the heat-insulating property.

It is preferable to divide the horizontal rib 4 into four to eight rib portions by the discontinued portions 8 an the entire periphery of the container 30. The ratio of the total area of the discontinued portions 8 to the entire periphery of the horizontal rib 4 is preferably up to 30%.

Figures 3A, 3B, 3C:
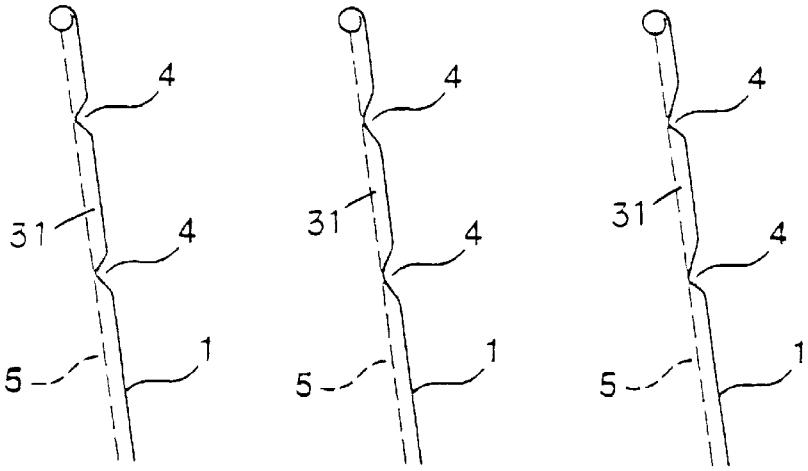
FIG. 3 is a cross-sectional view illustrating the horizontal rib of the heat-insulating container of the first embodiment of the present invention.

FIG. 3 is a cross-sectional view illustrating the horizontal rib of the heat-insulating container of the first embodiment of the present invention. The horizontal rib 4 formed on the cup body 10 preferably has a sharp-pointed shape as shown in FIG. 3(*a*) in order to ensure a large heat-insulating space 31. It is however necessary to use a sheet of paper having an excellent cup-forming property for forming the cup body 10, in order to apply the cup forming process to form the shape as shown in FIG. 3(*a*). On the contrary, it is easy to form the horizontal rib 4 having gentle slopes as shown in FIG. 3(*b*) without using the specific sheet of paper as mentioned above. However, in the construction as mentioned in FIG. 3(*b*), the contacting area of the side shell-wall 1 with the side wall 5 of the tubular member 20 is relatively large and the heat-insulating space 31 is reduced, with the result that an excellent heat-insulating property cannot be provided. It is therefore most preferable to form the horizontal rib 4 having the cross section as shown in FIG. 3(*c*) in view of the excellent heat-insulating property and the excellent cup-forming property. Reasons therefor will be stated later. The horizontal rib 4 as shown in FIG. 3(*c*) has a shape in the vertical cross section so that an inclination angle of the upper portion of the rib 4 locating above a peak of the rib 4 relative to the vertical line passing through the peak is smaller than an inclination angle of the lower portion of the rib 4 locating below the peak relative to the vertical line.

FIGS. 1 to 3 have illustrations in which all the horizontal ribs 4 come into contact with the tubular member 20. However, at least one of the horizontal ribs 4 may come into contact with the tubular member 20. The existence of the horizontal rib 4, which does not come into contact with the tubular member 20, can provide the effect of maintaining the lower temperature of the outer surface of the heat-insulating container 30 after boiling water is poured into it for cooking dried food received therein, thus making it possible to hold the heat-insulating container 30 with hand, although slight deformation may occur. The reasons therefore are that the horizontal rib kept away from the tubular member 20 can provide the effects of enlarging the heat-insulating space 31 and facilitating the convection of air in the vertical direction between the side shell-wall 1 and the side wall 5 of the tubular member 2, thus promoting the dispersion of heat.

Figure 4A:
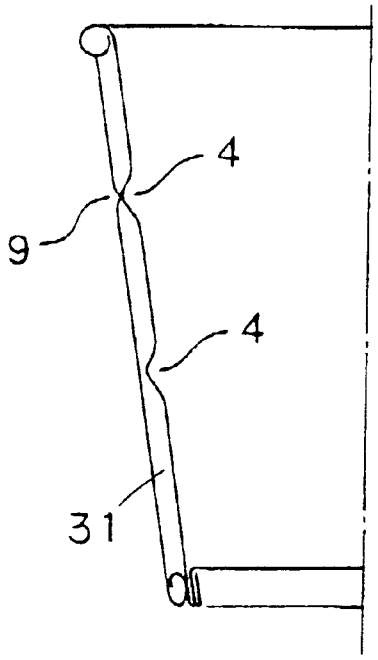
FIG. 4 is a descriptive view illustrating the modification of the horizontal rib in the heat-insulating container of the first embodiment of the present invention.
Figure 4B:
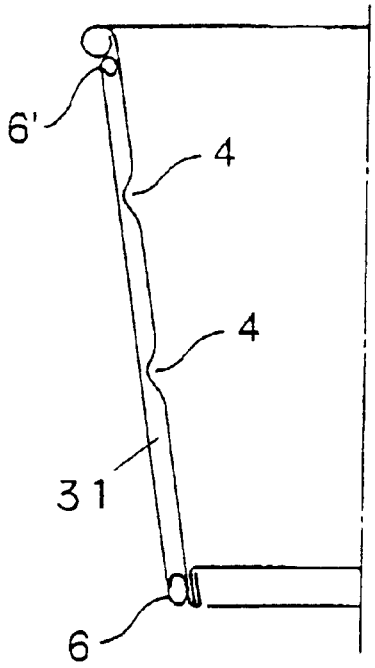

FIG. 4 is a descriptive view illustrating the modification of the horizontal rib in the heat-insulating container of the first embodiment of the present invention. In the present invention, the other horizontal rib 9 projecting toward the inside of the tubular member 20 may be formed so as to face the horizontal rib 4 of the cup body 10 as shown in FIG. 4(*a*).

In general, there is limitation in height of the horizontal rib, in accordance with the quality of paper in the formation of the horizontal rib. Consequently, it is impossible to form the horizontal rib having an extremely large height. Combining the horizontal rib 4 of the side shell-wall 1 with the horizontal rib 9 of the tubular member 20 so as to face it can provide the same effect as in the case where a single horizontal rib having the height equal to the total height of these horizontal ribs 4, 9, thus making it possible to increase the width of the heat-insulating space 31. In addition, an inward curled portion 6' may also be provided on the upper edge of the tubular member 20 to ensure the heat-insulating space 31 in the upper portion of the heat-insulating container 30.

Now, description will be given below of a method for manufacturing the heat-insulating container 30 of the present invention.

First, the tubular member having a truncated conical shape for forming the side shell-wall 1 is formed from a blank sheet having a fan-shape with the use of a cup-forming machine. The bottom plate 2 is then supplied to a position corresponding to the lower end of the tubular member in the cup forming machine to carry out a seaming treatment to seam the outer periphery of the bottom plate 2 and the lower end of the tubular member, thus forming the bottom of the paper cup body 10. Then, the outward curled portion 3 is formed at the upper edge of the tubular member. Then, the horizontal ribs 4 are formed, thus completing the formation of the cup body 10.

The step for forming the horizontal ribs 4 may be carried out under the on-line condition of the cup-forming machine or under the offline condition thereof. More specifically, it is possible to form the horizontal ribs 4 projecting outward from the cup body 10 by putting the formed cup body 10 having no ribs into a forming cavity of a mold, which has grooves corresponding to the horizontal ribs 4 and strongly pressing the inner surface of the cup body 10 toward the grooves through a roller, which is urged by means of an expander, while rotating the cup body 10 in its circumferential direction.

In this case, when the roller is pressed continuously on the entire periphery of the cup body 10, there can be formed the horizontal ribs 4 as shown in FIG. 2(*a*), which extend continuously over the entire periphery of the cup body 10. When the roller is pressed only on the portions along the circumferential direction of the cup body 10, there can be formed the horizontal ribs 4 as shown in FIG. 2(*b*), each of which extends intermittently in the circumferential direction of the cup body 10.

According to the forming process described above, it is necessary to pull out the cup body 10 from the forming cavity of the mold after the completion of formation of the horizontal ribs 4. The horizontal rib 4 having a gently inclined upper portion as shown in FIG. 3(*c*) causes the cup body 10 to be more easily pulled out from the forming cavity in comparison with the horizontal rib 4 having a sharp pointed portion as shown in FIG. 3(*a*), thus leading to an excellent formability. The horizontal rib 4 may also be formed by a drawing process utilizing male and female dies.

The tubular member 20 can be prepared on the other hand by punching a cut sheet or a rolled sheet of cardboard or coated fiberboard, on which a pattern, a logotype, characters or the like has previously been printed to form a fan-shaped blank sheet, applying an adhesively joining process to the thus formed fan-shaped blank sheet with the use of the cup forming machine to form a formed body having an inverse truncated conical shape, and curling the lower peripheral edge of the thus formed body to form the inward curled portion 6.

The thus formed cup body 10 is put into the tubular member 20 and the contact portions of them are joined with each other by means of an adhesive agent, thus completing the preparation of the heat-insulating container 30 of the present invention. The adhesively joining process applied to at least one of the contact portions suffices as described above. After the completion of the formation of the heat-insulating containers, they may be supplied in a stacked state to a place where the next step is carried out.

Figure 5:
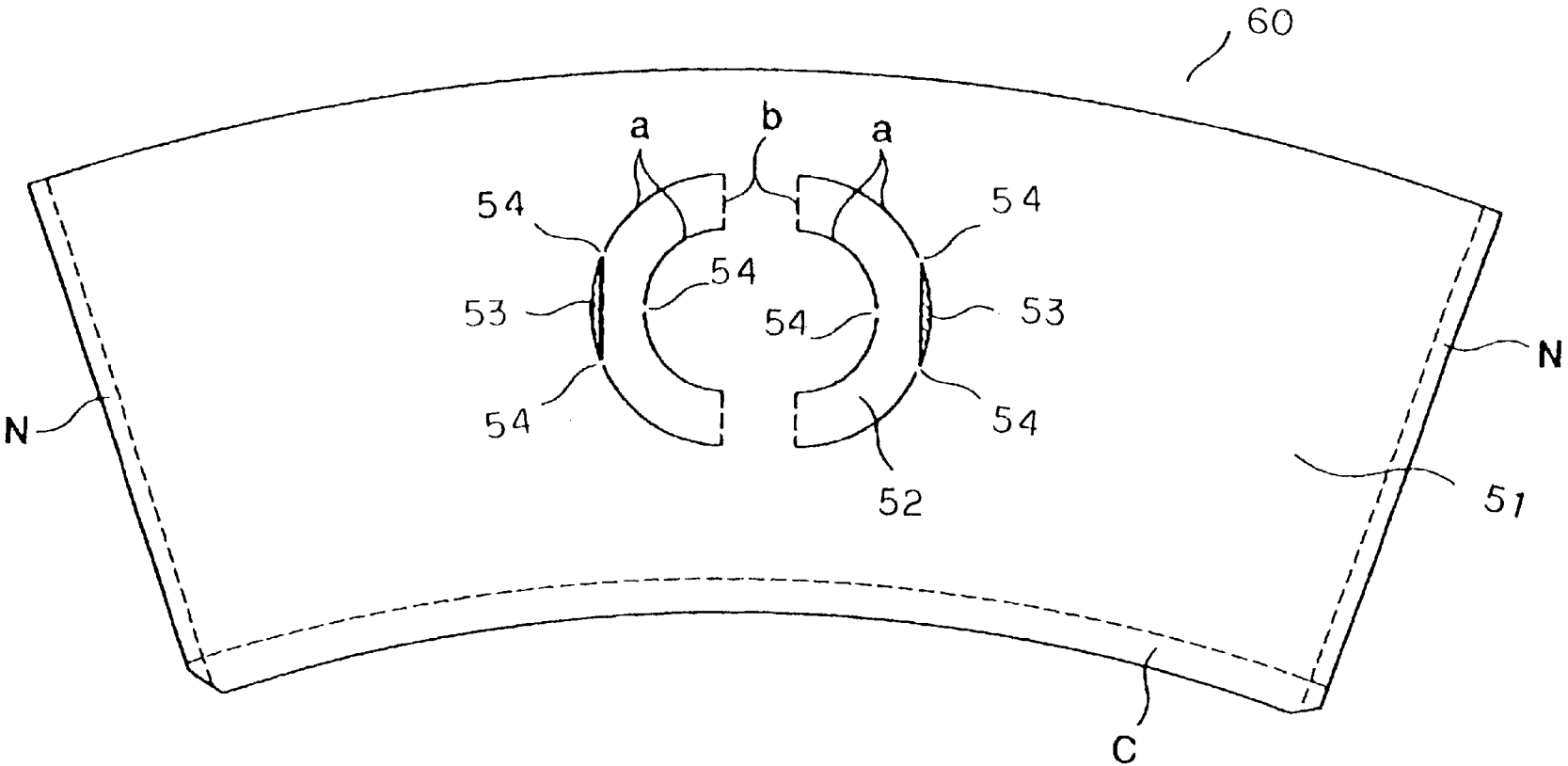
FIG. 5 is an extended elevation view of a blank sheet for an outer tubular member used for the heat-insulating container of the second embodiment of the present invention.

FIG. 5 is an extended elevation view of a blank sheet for an outer tubular member 80 (see FIG. 8) used for the heat-insulating container of the second embodiment of the present invention. The blank sheet 60 for the tubular member is formed by punching a sheet of paper into a fun-shape. The opposite side edge portions N, N' of the blank sheet 60 serve as portions to be adhesively joined with each other to form a shell. The blank sheet 60 has the lower edge portion C on which the inward curled portion is to be formed. The portion of the blank sheet 60 other than the above-mentioned curled portion forming portion C forms an outer wall 51 for the heat-insulating container having a handle of the second embodiment of the present invention.

The blank sheet 60 is provided on its central portion with two handle-shaped pieces 52, 52, which locate symmetrically so as to be adjacent to each other. These handle-shaped pieces 52, 52 are formed simultaneously when the punching process is applied to the blank sheet 60. Each of the handle-shaped pieces 52, 52 is defined by two cutting lines, i.e., inner and outer arcuate cutting lines "a, a" and two folding lines connecting the corresponding edges of the cutting lines "a, a", respectively. A cutout 3 is formed along each of the outer cutting lines "a, a" by means of a punching process. A plurality of connection portions 54 . . . 54, which can easily be cut off, are formed along the cutting lines "a, a".

Figure 6A:
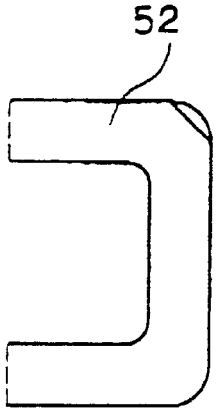
FIG. 6 is a view illustrating the modification of the handle-shaped piece.
Figure 6B:
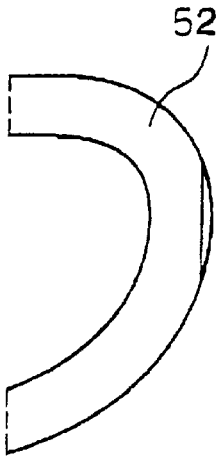
Figure 6C:
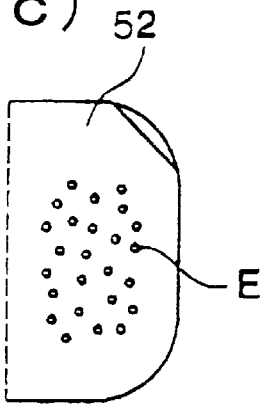

FIG. 6 shows the modifications of the handle-shaped piece. The shape of the handle-shaped piece 52 is not limited only to the semi-arcuate shape as shown in FIG. 5. The handle-shaped piece 52 may have a rectangular shape as shown in FIG. 6(*a*) or an ear-shape as shown in FIG. 6(*b*). The handle-shaped piece 52 may have a single outer cutting line as shown in FIG. 6(*c*). With respect to an example as shown in FIG. 6(*c*), the two handle-shaped pieces 52, 52 facing each other of the heat-insulating container can be held with fingers. Such a handle structure can be adopted when the heat-insulating container has a small size and is light in weight. An embossing process may be applied to the central portion of the handle-shaped piece 52 to form irregularity for preventing slip.

Figure 7:
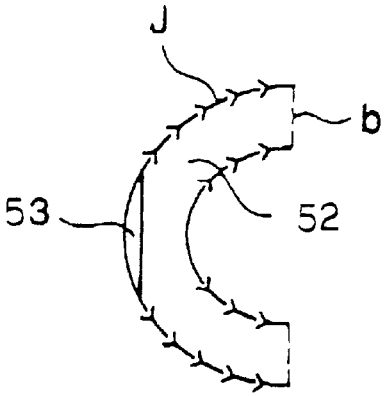
FIG. 7 is a view illustrating the modification of the cutting line.

FIG. 7 shows the modification of the cutting line. The cutting line "a" as shown in FIG. 5 is formed into a curved line. The cutting line may be formed into a so-called zipper-shape having a plurality of Y-shaped portions as shown in FIG. 7 or of the other shaped portions.

Figure 8A:
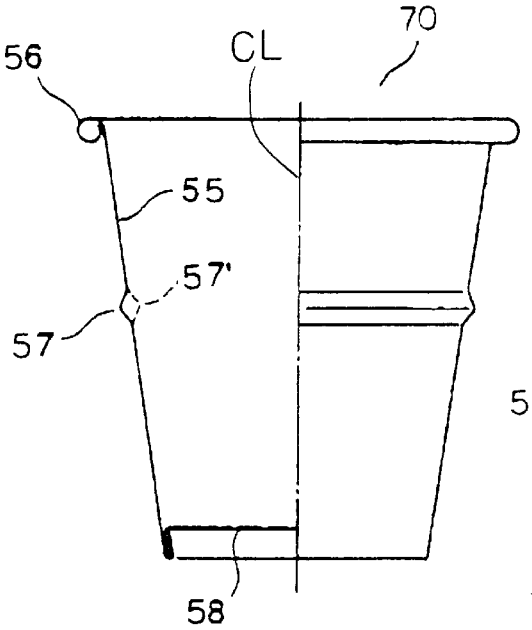
FIG. 8 is a descriptive view of a structure of a heat-insulating container of the second embodiment of the present invention.
Figure 8B:
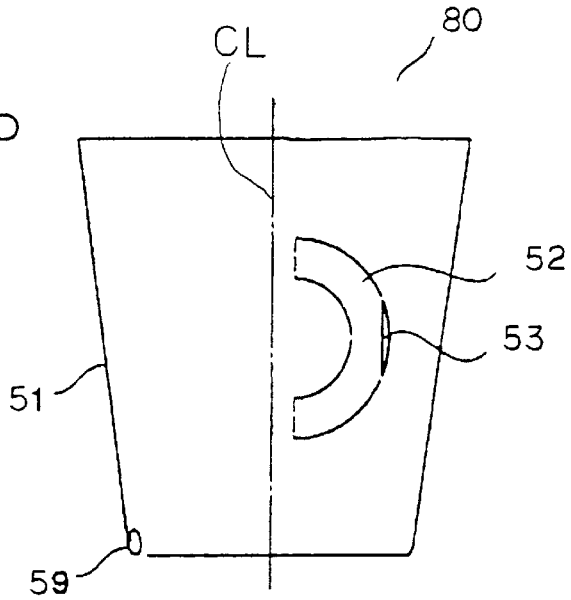
Figure 8C:
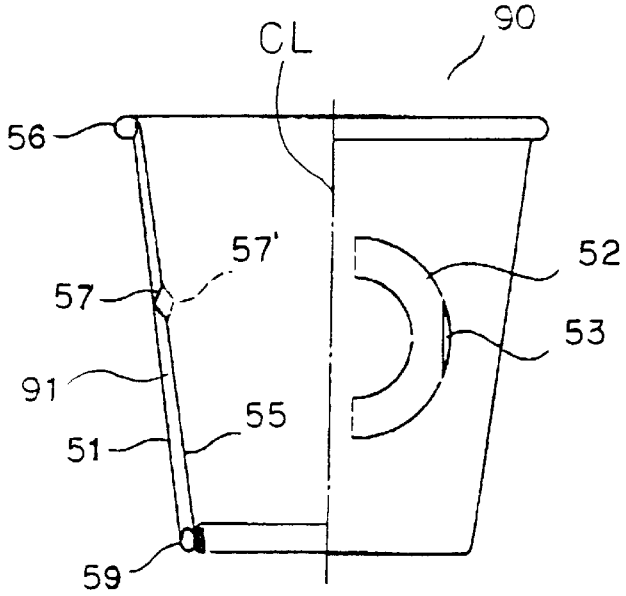

FIG. 8 is a descriptive view of the structure of the heat-insulating container of the second embodiment of the present invention. The heat-insulating container 90 as shown in FIG. 8 has a paper cup body 70 and a tubular member 80. Both of the paper cup body 70 and the tubular member 80 are formed of a sheet of paper. The right-hand side relative to the central line CL in each of FIGS. 8(*a*) to 8(*c*) shows the external appearance of the container and the left-hand side relative thereto shows the cross section of the container.

The paper cup body 70 has a side shell-wall 55 and a bottom plate 58. As shown in FIG. 8(*a*), the side shell-wall 55 is provided on its upper edge with an outward curled portion 56. The side shell-wall 55 is provided on its middle portion with a single horizontal rib 57 projecting outward. The number of the horizontal rib is not limited to one and two or more ribs may be provided. As shown in FIG. 8(*b*), the tubular member 80 is formed of the blank sheet 60 as shown in FIG. 5 into an inverse truncated conical shape having the opposite openings. The tubular member 80 is provided on its lower edge with an inward curled portion 59. The tubular member 80 is provided on its intermediate portion with handle-shaped pieces 52. The paper cup body 70 and the tubular member 80 are combined with each other to form an integral body as shown in FIG. 8(*c*). In such a combination, the inner surface of the tubular member 80 comes into contact with the outer periphery of the horizontal rib 57 and the inner periphery of the inward curled portion 6 of the tubular member 80 comes into contact with the outer periphery of the lower portion of the side shell-wall 57, which forms the bottom of the paper cup body 70.

The horizontal rib 57 has functions of supplementing the strength of the cup body 70 as well as forming a heat-insulating space 91, which is substantially uniform in width in the vertical direction, so as to prevent the side wall of the tubular member 80 from being deformed inward to impart a stable heat-insulating property to the heat-insulating container 90. The deformation of the tubular member 80 depends on the basic weight of the sheet of paper for forming the tubular member 80. With the basic weight of up to 270 g/m$^2$, an amount of deformation of the tubular member 80 becomes larger. It is preferable to provide the horizontal rib 57 projecting outward in view of the stable heat-insulating property. The horizontal rib 57 projecting outward may be substituted by a horizontal rib 57' projecting inward as shown in dotted lines in FIG. 8(*a*). The formation of the horizontal rib 57' can supplement sufficiently the strength of the cup body 70, although the horizontal rib 57' does not come into contact with the tubular member 80.

There may be adopted a structure that the upper edge of the tubular member 80 and the upper edge of the side shell-wall 55 of the cup body 70 come into contact with each other without forming the horizontal ribs 57, 57'. In this case, the width of the heat-insulating space 91 (i.e., the gap in the radial direction) gradually becomes smaller toward the upper end. A plurality of horizontal ribs 57, 57' may be formed. The position of the horizontal rib 57 or 57' may be determined taking into consideration the balance in strength of the cup body 70. One of the horizontal ribs may serve as a line indicating an appropriate level to which boiling water is to be poured into the cup body 70, i.e., a standard line for boiling water. The tubular member 80 and the side shell-wall 55 are adhesively joined to each other so that the tubular member 80 does not come off the paper cup body 70. An adhesion step applied to at least one of contact portions of the paper cup body 70 with the tubular member 80 (i.e., two contact portions on the outer periphery of the horizontal rib 57 and the inner periphery of the curled portion 59 in FIG. 8) suffices.

Figure 9A:
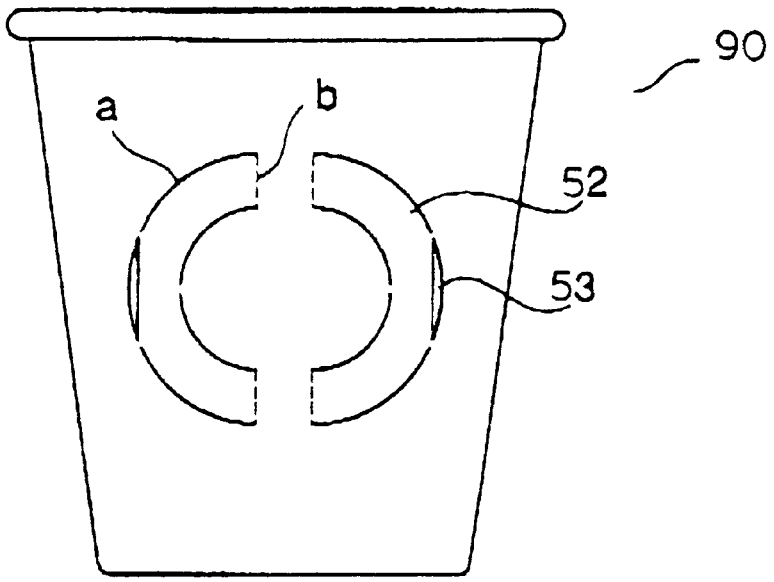
FIG. 9 is a view illustrating the heat-insulating container of the second embodiment of the present invention in a use state.
Figure 9B:
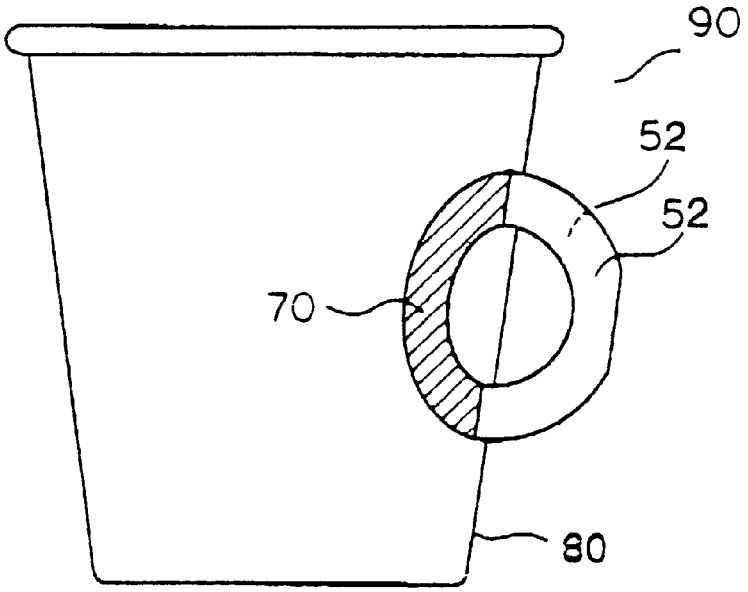

FIG. 9 is a view illustrating the heat-insulating container 90 having a handle of the second embodiment of the present invention in a use state. FIG. 9(*a*) is a front view illustrating the heat-insulating container 90 of the present invention, in which the handle-shaped pieces 52 have not as yet been pulled out. FIG. 9(*b*) is a side view illustrating the heat-insulating container 90 of the present invention, in which the handle-shaped pieces 52 have already been pulled out. In order to eat the instant food received in the heat-insulating container 90, the handle-shaped pieces 52 formed on the shell of the tubular member 80 are first pulled out from the cutouts 53. Then, the handle-shaped pieces 52 are further pulled out while tearing the connection portions 54 (see FIG. 5) and are folded along the folding lines "b" at right angles. A handle composed of the two handle-shaped pieces 52 can easily be formed on the middle portion of the shell. Then, a cover member (not shown), which has been heat-sealed to the outward curled portion 56 of the cup body 70, is peeled off and boiling water is poured into the cup body 70. After the completion of cooking, the assembled handle of the heat-insulating container can be held with fingers so as to eat the cooked food without feeling hot.

Each of the heat-insulating containers 30, 90 of the present invention has a capacity of 200 to 500 cc. When the paper cup body 10, 70 having the capacity within the above-mentioned range is formed by means of the conventional paper cup-forming machine, it is preferable to use a sheet of paper having a basic weight within the range of from 160 g/m$^2$ to 300 g/m$^2$. In general, the inner surface of the sheet of paper for the cup body is coated with polyolefin resin such as low density polyethylene resin, medium density polyethylene resin, high density polyethylene resin, linear low density polyethylene resin, or the like with the use of an extrusion coating method in an amount of 20 to 80 $\mu$m.

The resultant polyolefin resin layer has functions of improving the cup formability in the bottom, the curled portion and the shell of the cup, ensuring the sealing property of the cover (not shown) heat-sealed by means of a heat-sealing method, in addition to functions of protecting the contents received in the container from penetrating into the sheet of paper and improving the protective property for the contents.

With respect to the fact that boiling water comes into contact with the plastic layer formed on the inner surface of the container, there should be remarkably taken into consideration the food hygiene problem that may occur due to elution of monomer, heavy metals and other additives remaining in the plastic material. It is natural to limit the amount of these eluted materials so as not to exceed the standard values prescribed by laws or official rules. It is however preferable to refrain from using resin such as bisphenol A eluted from polycarbonate resin, which has been widely used for dishes for school-food service, that resin elutes endocrine disruptors (i.e., exogenous endocrine disrupting chemicals), which have been reported to be disruptive to endocrine, even if the resin content is excessively small and under the standard value.

Any one of the low density polyethylene resin, the medium density polyethylene resin, the high density polyethylene resin and the linear low density polyethylene resin does not cause such a problem and can be used safely for the coating of the inner surface of the heat-insulating container 30, 90.

With respect to the sheet of paper for forming the tubular member 20, 80, an excellent printing property as well as an excellent roll-forming property are required. With respect to the tubular member 80, a sufficient rigidity is also required for the handle. It is preferable to use, as the above-mentioned sheet of paper, a sheet of coated fiberboard having a basic weight within the range of from 230 g/m$^2$ to 350 g/m$^2$ or a sheet of cardboard having a basic weight within the range of from 160 g/m$^2$ to 250 g/m$^2$.

With the basic weight of under the lower limit mentioned above, the rigidity of the tubular member 20, 80 may remarkably decreases, and a serious deformation of the tubular member 20, 80 may easily occur at an high temperature, thus leading to a poor heat-insulating property. With the basic weight of over the upper limit mentioned above, the forming property of the inward curled portion 6,59 may deteriorate and the cost of material used for the tubular member 20, 80 may increase, thus causing unfavorable problems. With respect to the tubular member 80, the basic weight of under the lower limit mentioned above makes it easy to deform the tubular member 80, depending upon an amount of boiling water poured into the container, when the handle of the container is held with fingers.

When the material used for the tubular member 20, 80 is subjected to a resin coating process or a resin impregnating process, it is possible to improve the rigidity, the proof compressive property, the proof collapsing property and the like of the entirety of the heat-insulating container 30, 90 so as to protect the contents received in the container from an external force applied to thereto during distribution of the container.

The heat-insulating container, which has not only a stable heat-insulating property over its entirety, but also a sufficient rigidity to prevent the occurrence of deformation of the container permits to improve safety and reliability required for a container, which is to be filled with boiling water to make an instant dried food eatable received in the container, and is to be held at its shell or the handle with a hand in order to eat the food. Such properties are considered as important factors especially for aged persons, physically handicapped persons and children, as well as essential factors required for barrier-free goods. With respect to the tubular member 80, the rigidity of the handle itself and especially the easily handling property are considered as important factors. Provision of the handle having an optimized shape is considered to be one of the essential factors required for barrier-free goods.

When the heat-insulating container 90, which has a sufficient heat-insulating property and is filled with boiling water, is held a single hand, the direct holding of the shell of the container can provide a more stable condition in comparison with the holding of the handle of the container. It is however necessary to increase the distance between the dual side wall members 51, 55 in order to impart the sufficient heat-insulating property to the container. As a result, the thickness of the side wall of the heat-insulating container 90 increases so that the so-called "stacking pitch" (i.e., the distance between the containers arranged in a stacked state) increases, thus deteriorating transportation efficiency of the containers. According to the heat-insulating container 90 having the handle of the present invention, the moderate heat-insulating property that is ensured by the dual side walls 51, 55 suffices with the result that the thickness of the side wall can be decreased smaller than the conventional heat-insulating container. Consequently, it is possible to provide the heat-insulating containers, which have the small stacking pitch and excellent transportation efficiency.

The heat-insulating container 30, 90 of the present invention is formed of paper so as to be disposed easily without being subjected to segregated disposal. Although the heat-insulating container 30, 90 of the present invention has sufficient rigidity for preventing its deformation, it can easily be collapsed by a small force given by a hand. Accordingly, it is possible to decrease the volume of the container in the light of disposal thereof. The container of the present invention has an excellent disposability and a smaller adverse influence on environment in comparison with the other conventional heat-insulating container using foamed plastic as the heat-insulating material.

In addition, no uneven portion is formed on the side shell-wall 1, 51 of the heat-insulating container 30, 90 of the present invention and in other words, the side shell-wall has the smooth outer surface. The inward curled portion 6, 59 of the tubular member 20, 80 locates at the bottom of the container so as to reveal a moderate curvature. The heat-insulating container 30 therefore has an elaborated design as a cup-shaped container. The gap formed between the cup body 10, 70 and the side wall 1, 5, 51, 55 of the tubular member 20, 80 at the bottom of the container is sealed with the inward curled portion 6, 59 so as to prevent dust or foreign matters from entering the heat-insulating space 31, 91 and to prevent liquid from being absorbed from the edge of the sheet of paper for forming the cup body 10. The heat-insulating container 30, 90 of the present invention can be kept hygienic.

The tubular member 20, 80 has a high degree of freedom in printing, and can therefore be subjected without specific restriction not only to the conventional printing process such as an offset printing, a gravure printing, a flexo graphic printing or the like, but also to the conventional process such as an overcoating process, a stamping process, an embossing process or the like, which are to be carried out after the completion of the printing process. As a result, such printing and processing properties can provide an excellent aesthetic effect in cooperation with the smooth outer surface of the container mentioned above. It is further possible to form an overcoating layer of varnish on the side wall of the tubular member 20, 80 and/or the surface of the inward curled portion 6, 59 so as to prevent these portions from being wetted and becoming unclean.

EXAMPLE 1

The sample of the heat-insulating container 30 of the first embodiment of the present invention was prepared in accordance with the following manner.

| Particulars of the cup body 10 | |
|---|---|
| Capacity: | 460 cc |
| Inside diameter of the upper end of the side shell-wall: | 89 mm |
| Outside diameter of the bottom: | 65 mm |
| Height: | 107 mm |
| Material: | Sheet of paper having a basic weight of 280 g/m$^2$ provided with a polyethylene layer of 25 $\mu$m |
| Number of the horizontal ribs: | 2 |
| Width of the upper rib: | 2 mm |
| Width of the lower rib: | 6 mm |
| **Particulars of the tubular member 20** | |
| Inside diameter of the inward curled portion: | 65 mm |
| Thickness of the inward curled portion: | 2 mm |
| Inside diameter of the upper end of the side wall: | 91 mm |
| Height: | 104 mm |
| Material: | Sheet of coated fiberboard having a basic weight of 310 g/m$^2$ provided with a printing layer and an over coating layer of varnish |

The tubular member 20 was brought into contact with the cup body 10 at the two horizontal ribs 4 and the side wall of the bottom and the contact portions were joined with each other by means of an acrylic emulsion type adhesive agent. The sample of the invention having the heat-insulating space 31, in which the upper gap was 1 mm and the lower gap was 2 mm, was prepared in this manner. The heat-insulating container 100 as shown in FIG. 1, which had no horizontal rib 4, was prepared as a comparative example.

Boiling water having a temperature of 95° C. was poured into each of the samples in an amount of 240 cc so as to reach the level line for the boiling water. After the lapse of time of 2 or 3 minutes, the middle portion of the shell of each of the samples was held by a hand to make a tactile inspection of temperature on the outer surface of each of the samples. The above-mentioned tactile inspection revealed the fact that the sample of the present invention was more excellent in heat-insulating property, especially on the upper and middle portions of the container than the comparative sample, thus making it possible to hold the sample of the former without perceiving the high temperature. The sample of the invention had a sufficient rigidity over the entirety of the container so that it can be held firmly by a hand without perceiving change in temperature. On the contrary, the tubular member of the comparison example gradually deformed inward and perceived temperature increased according as the holding force increased.

EXAMPLE 2

The sample of the heat-insulating container 90 of the second embodiment of the present invention was prepared in accordance with the following manner. Dimensions and angles of the components of the container are indicated in FIG. 10.

Figure 10:
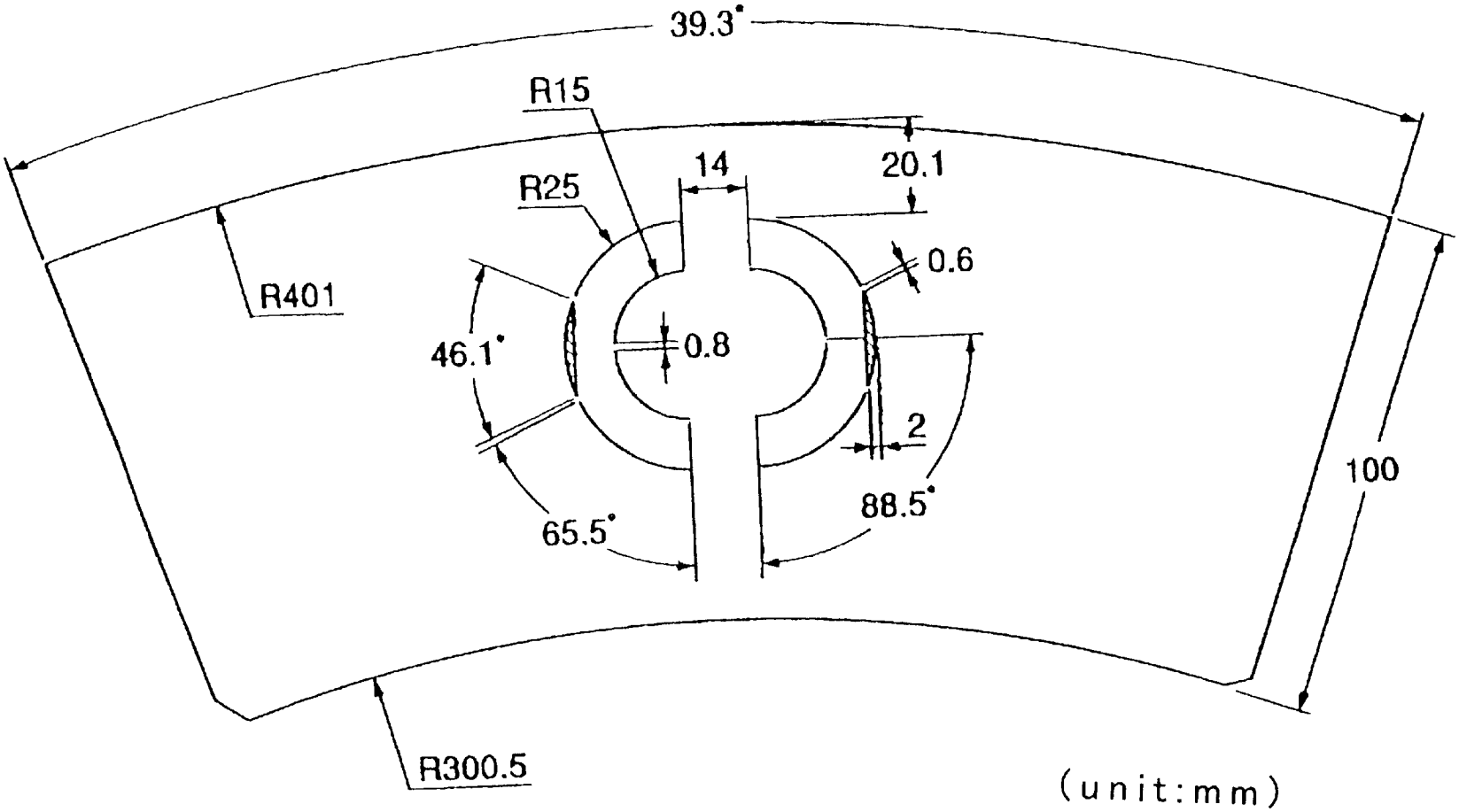
FIG. 10 is a view illustrating the dimensions of the blank sheet used in the second embodiment of the present invention.

| Particulars of the cup body 70 | |
|---|---|
| Capacity: | 380 cc |
| Inside diameter of the upper end of the side shell-wall: | 87 mm |
| Outside diameter of the bottom: | 68 mm |
| Height: | 92 mm |
| Material: | Sheet of paper having a basic weight of 250 g/m$^2$ provided with a polyethylene layer of 25 $\mu$m |
| Number of the horizontal ribs: | 1 |
| Width of the upper rib: | 7 mm |
| **Particulars of the tubular member 80** | |
| Shape and dimensions of the handle: | as indicated in FIG. 10 |
| Inside diameter of the inward curled portion: | 66 mm |
| Thickness of the inward curled portion: | 3 mm |
| Inside diameter of the upper end of the side wall: | 88 mm |
| Height: | 91 mm |
| Material: | Sheet of coated fiberboard having a basic weight of 270 g/m$^2$ provided with a printing layer and an over coating layer of varnish |

The cup body 70 was provided with a single horizontal rib 57. The single horizontal rib 57 was brought into contact with the tubular member 80. The tubular member 80 and the cup body 70 were joined with each other at their lowermost contact portions by an acrylic emulsion type adhesive agent.

The conventional double-layer type heat-insulating container having no handle (see FIG. 11) was prepared as a comparative example.

Boiling water having a temperature of 95° C. was poured into each of the samples in an amount of 240 cc so as to reach the level line for the boiling water. After the lapse of time of 2 or 3 minutes, the handle of the sample of the invention was held with a hand and the comparative example was held at its portion locating below the level line, to make a tactile inspection of temperature for each of the samples. The above-mentioned tactile inspection revealed the fact that there was no perception of heat in the sample of the invention. On the contrary, the comparison sample could not be held with a hand due to its high temperature.

With respect to the sample of the invention, the holding of the container for a long period of time caused fatigue of fingers. It was therefore recognized that the sample of the invention was suitable for a small-sized container for receiving instant dried Western soup, instant dried miso soup, instant coffee or the like, over which boiling water was to be poured in a relatively small amount. The shape and size of the handle depend on personal preference. It is preferable to select an optimized shape of the handle, by which the container can easily be held, in accordance with the kind of contents received in the container.

According to the heat-insulating container of the present invention described above, which has the rib, it is possible to provide the heat-insulating container formed of paper, in which the stable heat-insulating property can be provided, irrespective of the portion of the container at which the container is held and how to hold it. The above-mentioned heat-insulating container has a smooth outer surface, a high-grade external appearance and a high degree of freedom in indication by printing.

The rigidity of the entirety of the container can be increased so as to prevent the container from being deformed, in addition to the improved heat-insulating property. As a result, there can be provided advantages of holding easily the container and improving safety in physical and hygienic aspects in the container for receiving an instant dried food to become eatable by pouring boiling water over it. In addition, it is possible to reduce the material cost and the production cost so as to take the heat-insulating container to the market at a reasonable cost. After the heat-insulating container is used, it can be disposed as waste paper and it is also easy to decrease the volume of the container in the light of disposal thereof, thus leading to an excellent disposability. The container can easily be recycled. Thus, the present invention contributes to decrease in adverse influence on environment.

The heat-insulating container having the handle can provide advantage that the handle of the container can be held with a hand without perceiving the high temperature, even if the heat-insulating property of the shell of the container is deteriorated. The moderate heat-insulating property suffices with the result that the thickness of the shell having the double layer structure can be decreased smaller than the conventional heat-insulating container. Consequently, it is possible to provide the heat-insulating containers, which have the small stacking pitch and excellent transportation efficiency.

What is claimed is:

1. A heat-insulating container, which comprises:

a paper cup body having an inner surface, an upper open end, a shell member and a bottom, said inner surface being coated with polyolefine resin, said upper open end having an outward curled portion and said shell member having a side wall on which at least one rib is formed; and a tubular member being formed of paper and having an inverse truncated conical shape, said tubular member having at a lower end thereof an inward curled portion;

said tubular member being combined with an outer periphery of said paper cup body so as to come into contact with said paper cup body in contact portions provided on said at least one rib of said paper cup body and on an outer periphery of an lower end of said side wall of said shell member.

2. The heat-insulating container as claimed in claim 1, wherein:

said tubular member is adhesively joined to said paper cup body in at least one of said contact portions.

3. The heat-insulating container as claimed in claim 1 or 2, wherein:

said rib continuously extends over an entire periphery of said side wall of the shell member of the paper cup body.

4. The heat-insulating container as claimed in claim 1 or 2, wherein:

said rib intermittently extends along a periphery of said side wall of the shell member of the paper cup body.

5. The heat-insulating container as claimed in claim 1, wherein:

said inward curled portion formed on the lower end of the tubular member is adhesively joined to said side wall of the shell member of the paper cup body.

6. The heat-insulating container as claimed in claim 1, wherein:

said rib has a shape in a vertical cross section so that an inclination angle of an upper portion of said rib locating above a peak of said rib relative to a vertical line passing through said peak is smaller than an inclination angle of a lower portion of said rib locating below said peak relative to said vertical line.

7. The heat-insulating container as claimed in claim 1, wherein:

said tubular member has a rib, which projects inward so as to face said rib of said paper cup body.

* * * * *